United States Patent [19]

Margittai

[11] 4,349,934

[45] Sep. 21, 1982

[54] DOCTORING KNIFE FOR DRUM DRYERS AND FLAKERS

[76] Inventor: Thomas Margittai, c/o T.B.M. Technologies, Inc., 778 Cornwall Rd., State College, Pa. 16801

[21] Appl. No.: 234,985

[22] Filed: Feb. 17, 1981

[51] Int. Cl.[3] ..... F26B 25/04

[52] U.S. Cl. ..... 15/256.51; 34/120; 118/652; 162/281; 165/91

[58] Field of Search ..... 15/256.51; 100/174; 118/652; 101/425, 365; 162/281; 34/120; 165/91; 432/75; 198/497; 355/15

[56] References Cited

U.S. PATENT DOCUMENTS

| | | | |
|---|---|---|---|
| 2,673,494 | 3/1954 | Scott | 15/256.51 |
| 2,815,524 | 12/1957 | Mitchell | 15/256.51 |
| 2,898,855 | 8/1959 | Richter | 101/365 X |
| 3,699,888 | 10/1972 | Easoz | 101/365 |
| 3,871,953 | 3/1975 | Lee et al. | 162/281 X |
| 3,927,614 | 12/1975 | Malek | 101/365 X |

*Primary Examiner*—Edward L. Roberts

*Attorney, Agent, or Firm*—Buell, Blenko, Ziesenheim & Beck

[57] ABSTRACT

An improved doctoring knife for drum dryers and flakers of the type in which a product is deposited on a rotating drum and removed by action of the doctoring knife against the drum is disclosed. The improved doctoring knife is comprised of a series of knife blocks each having a cutting edge wherein the knife blocks are positioned adjacent to one another so that when the cutting edge of the knife block contacts the drum its bottom face will be in a plane substantially tangent to the line defined when the cutting edge contacts the drum. When a cutting edge is damaged the knife block containing the damaged edge can be removed and reground while undamaged knife blocks remain in position.

8 Claims, 2 Drawing Figures

DOCTORING KNIFE FOR DRUM DRYERS AND FLAKERS

Figure 1:
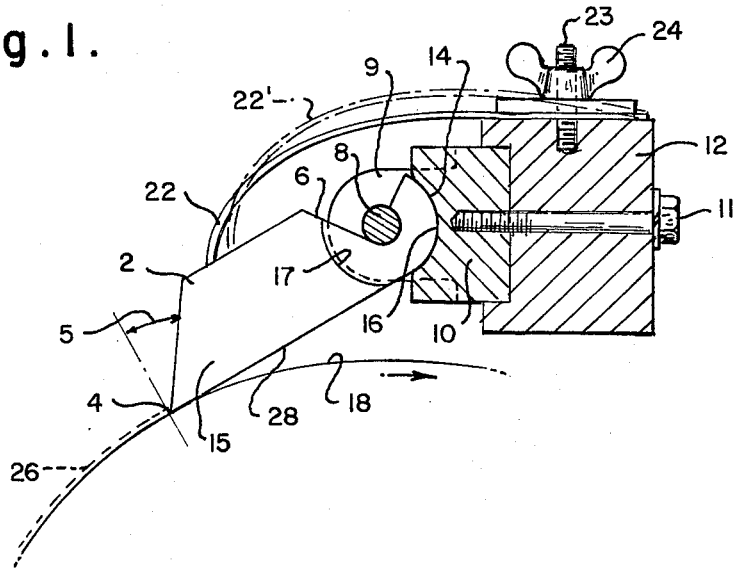

The present invention relates to knives called doctoring knives used to scrape dried material from a rotating drum. Rotating drum dryers also used as flakers are commonly used in the food and many chemical processing industries. The drum dryer (flaker) technology is very old and well known. One or two rotating drums heated (cooled) on the inside, are rotated slowly. A concentrated slurry is fed uniformly over the outside surface of the cylinder in a manner that the product, during the time of less than one rotation can be completely dried (cooled) and will stick to the drum surface. At this point, a very sharp knife, which is usually made out of hardened steel, is applied to the drum surface at a convenient angle in order to scrape the finished product off of the surface of the cylinder in the form of dry chips (flakes).

Under the prior art technology the doctoring knife must be pressed to the surface of the rotating drum creating a tendency for the knife to scratch the highly polished surface. If the drum surface is scratched the film of the product deposited on the drum will not be uniform. Thus, the drying (cooling) will be irregular and product residue will remain in the surface scratches. At the same time, the knife becomes dull and has to be reground periodically. Attempts to solve this problem by improving the surface hardness of the drums have not been totally successful.

The doctoring knives of the prior art consist of a single steel blade of sufficient length to span the length of the drum. The blade is bolted to a housing using a plurality of bolts. When the bolts are tightened a pressure differential is created within the blade which prevents the blade from uniformly expanding as temperatures change within the dryer (flaker).

I provide an improved doctoring knife comprised of a plurality of solid blocks each having a knife edge. The blocks are arranged in a row long enough to span the length of the drying drum. Each block is separately attached to a housing in a manner so that any individual block can be removed from the row for repair or replacement. When positioned in a dryer the cutting angle of the block will be the same as is used in the prior art doctoring knife it replaces. The bottom surface of the block follows a plane substantially tangent to the surface of the drum at a line where the knife edge of the block meets the drum.

The blocks of the present invention are easier to remove and grind than prior art knives. Unlike prior art doctoring knives they do not have a tendency to scratch the drum surface. Accordingly, damage to both the drum and the knife edge is less likely.

I prefer to provide blocks which clip onto a shaft mounted on the housing. Not being bolted to the supporting beam my improved doctoring knife does not contain any pressure differentials to prevent uniform expansion.

I further prefer to provide spring means for maintaining contact between the knife edge and the rotating drum.

Other details objects and advantages of the invention will become apparent as the following description of a present preferred embodiment thereof proceeds.

Figure 2:
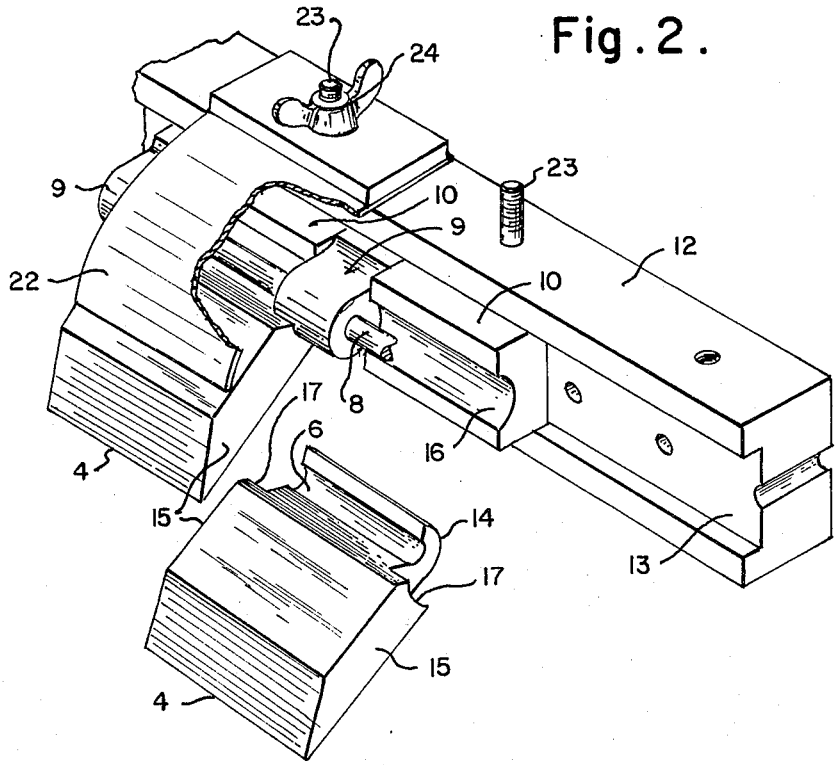

In the accompanying drawings I have shown a present preferred embodiment of the invention in which:

FIG. 1 is a side elevational view partly in section of the present preferred embodiment of my invention, and FIG. 2 is a partial exploded view of the same embodiment in isometric form.

Referring to the drawings I provide a plurality of rhombus-shaped knife blocks 2. A knife edge 4 is provided on one face of the knife block with the cutting angle 5 established by practice to be a convenient one. A slot 6 is provided in the top of the block to permit the knife to be rotatably attached to rod 8. The rod 8 passes through mounting blocks 9 bolted to mounting beam 12 which is attached to the frame of the dryer or flaker (not shown). The knife block 2 is held in place by a pillow 10 bolted permanently by bolt 11 to the mounting beam 12. The mounting beam 12 is journaled to provide an index cavity 13 in which the mounting blocks 9 and pillows 10 are inserted. The index cavity 13 is provided to assure proper alignment of mounting blocks 9 and pillows 10. A curved face 14 is provided on the back of the knife block 2 opposite the cutting edge 4. When the knife block 2 is in an operating position curved face 14 will be seated in a compatable curved depression 16 provided in the pillow block 10 and the sides 15 of adjacent blocks will abut one another. The knife edge 4 will rest upon the drum 18 and the bottom surface 28 of the block 2 will be on a line tangent to the drum surface at the point of knife edge contact. An indentation 17 is provided on the sides of each knife block 2 to permit them to fit over the rod mounting blocks 9. The knife block 2 is held in an operable position by a spring member 22 attached to the mounting beam 12. The spring member may be a suitably shaped piece of spring steel as shown or a cross-piece attached to the mounting beam and having a spring perpendicularly mounted on its opposite end. The spring member 22 is mounted to the mounting beam through posts 23 and wing nuts 24.

By adjusting the wing nut 24 one can change the load on the spring from a relaxed position, illustrated in FIG. 1 by chain line 22', to the fully tensioned position of spring 22. I prefer to provide a spring having a width equal to the width of the knife block as shown in FIG. 2. Such springs will act as a shield for the mounting rod 8 and blocks 9 and 10.

Dried or cooled product 26 which has been deposited on the rotating drum 18 is removed as it strikes the knife edge 4. This oncoming product 26 exerts an added pressure on the sharp edge of the knife forcing it, in cooperation with the spring member 22 toward the surface of the drum. I prefer to position the knife block 2 so that its bottom face is in a plane tangent to the line created where the knife edge contacts the rotating drum. Regrinding the knife edge will shorten the length of the knife block. Thus, when the reground block is placed in the dryer its bottom face will be in a plane different from the plane in which the bottom face was located before grinding. Nevertheless, that new plane will be substantially tangent to the drum at the line of contact by the cutting edge. So positioned, the knife block 2 does not have a way to create meaningful radially-directed pressure to damage the drum because the block sits on the tangent line to the surface. Thus, it cannot develop any radial movement or deformation to damage the drum 18.

The knife block 2 can be removed from the unit by releasing or removing the spring member 22 and rotating the knife block until rod 8 can pass through slot 6. A series of mounting blocks 24 hold the rod 8 in place after the knife block has been removed. In my present preferred embodiment I divide up the knife in blocks of approximately four inches wide, each one hinged independently, to create the total length of the knife needed for the drum. The distance between adjacent knife blocks should be as small as possible to prevent accumulation of deposited material between the knife blocks. I have found gaps of not larger than 0.01 inches to be acceptable. Should the knife edge become damaged the block containing the damaged area can be removed and replaced or reground. It is easier and less expensive to repair or replace a knife block of my invention rather than a prior art knife.

The knife block can be made from either a soft material such as teflon, aluminum and bronze or a very hard material such as hardened steel, glass and ceramics. The choice will depend upon the user's needs.

While I have shown and described a present preferred embodiment of the invention it is to be distinctly understood that the invention is not limited thereto but may be otherwise variously embodied within the scope of the following claims.

I claim:

1. An improved doctoring knife for drum dryers and flakers of the type having a rotating drum upon which a product is deposited and a frame to which the doctoring knife is attached, said knife comprising:

(a) a plurality of knife blocks each having a cutting face and a bottom face which intersect to define a cutting edge, and (b) a means for attaching the knife blocks to the frame in a manner such that each knife block can be separately removed and the knife blocks can be retained in a position where:

(i) the cutting edge of each knife block will contact the drum thereby defining a line of contact, (ii) the bottom face of each knife block is in a plane which is substantially tangent to the drum at the line of contact, (iii) the knife blocks cannot create sufficient radially-directed pressure to damage the drum, and (iv) the blocks will be adjacent to one another with the cutting face of all knife blocks facing in one direction.

2. The improved doctoring knife of claim 1 wherein each knife block is four inches wide across its cutting face.

3. The improved doctoring knife of claim 1 wherein the knife blocks are attached in a manner so that a gap not larger than 0.01 inches is created between any two adjacent knife blocks.

4. The improved doctoring knife of claim 1 wherein the knife blocks are rotatably attached to the frame.

5. The improved doctoring knife of claim 1 also comprising a pillow means attached to the frame in such a manner that each knife block when its cutting edge contacts the drum will also contact and be supported by the pillow means across a face opposite its cutting face.

6. The improved doctoring knife of claim 1 also comprising a rod attached to the dryer and wherein each knife block has a cutout positioned and sized such that:

(a) the rod will pass transversely through the cutout, (b) the knife block can be rotated about the rod, and (c) the knife block can be removed from the dryer by lifting the knife block so that the rod passes longitudinally through the cutout.

7. The improved doctoring knife of claim 1 wherein the knife blocks are composed of a material selected from the group comprised of teflon, aluminum, bronze, steel, glass and ceramics.

8. The improved doctoring knife of claim 1 also comprising a spring means attached to the dryer and contacting the knife blocks in a manner so as to press the cutting edges against the drum.

* * * * *